US005593092A

United States Patent [19]

McMillan et al.

[11] Patent Number: 5,593,092

[45] Date of Patent: Jan. 14, 1997

[54] MONITOR WITH SAFETY VALVE

[75] Inventors: Stewart G. McMillan, Valparaiso; David J. Kolacz, Plymouth, both of Ind.

[73] Assignee: Task Force Tips, Inc., Valparaiso, Ind.

[21] Appl. No.: 546,662

[22] Filed: Oct. 23, 1995

Related U.S. Application Data

[63] Continuation of Ser. No. 253,227, Jun. 2, 1994, abandoned, which is a continuation of Ser. No. 166,722, Dec. 13, 1993, abandoned.

[51] Int. Cl.[6] ..... B05B 15/06; A62C 39/00

[52] U.S. Cl. ..... 239/285; 239/581.1; 239/587.2; 169/91; 137/355.18; 251/66

[58] Field of Search ..... 239/279, 285, 239/569, 570, 579, 581.1, 587.2, 587.5; 169/52, 70, 91, DIG. 3; 137/355.18, 343, 616.7; 251/66

[56] References Cited

PUBLICATIONS

Wellspring's Portable Monitor Brake, Wellspring Enterprises, undated.

*Primary Examiner*—Kevin P. Shaver

*Assistant Examiner*—Lisa Douglas

*Attorney, Agent, or Firm*—Marshall, O'Toole, Gerstein, Murray & Borun

[57] ABSTRACT

Apparatus including a monitor and a portable ground base comprising a liquid-carrying conduit having an inlet end and an outlet end. The inlet end is adapted to receive a liquid (such as water) from a supply, and the outlet end is attached to the intake of the monitor. The conduit of the base includes an intermediate portion that is normally close to the support or ground when the ground base is in the normal operating position. Mounted within the conduit is a valve that is movable between a closed position and an open position. The valve is biased toward the closed position by a mechanism including liquid flow through the conduit and a spring. A trip catch is connected between the valve and the conduit for releasably holding the valve in the open position to permit flow through the conduit. A trip is mounted on the ground base and connected to the trip catch, the trip being operable to sense tilting movement of the ground base and to disengage the catch, thereby enabling the valve to move to the closed position and block liquid flow.

12 Claims, 6 Drawing Sheets

MONITOR WITH SAFETY VALVE

This is a Continuation of U.S. application Ser. No. 08/253,227, filed Jun. 2, 1994, now abandoned which was itself a continuation of U.S. application Ser. No. 08/166,722, filed Dec. 13, 1993, now abandoned.

FIELD AND BACKGROUND OF THE INVENTION

This invention relates to fire fighting equipment, and more particularly to a safety mechanism for a portable monitor.

An effective piece of fire fighting equipment is known in this art as a monitor, which is essentially a water gun that produces a powerful stream of water. The stream leaving the nozzle produces such a strong reaction force that the nozzle cannot be controlled by hand. Instead, the nozzle either is mounted on a deck mount base which is secured to, for example, the top of a truck, or is mounted on a portable ground base which rests on a support surface such as the ground. In both instances, the nozzle may be manually turned on a vertical axis to change the direction of the stream and turned on a horizontal axis to change the angle of elevation of the stream.

A typical portable ground base includes a conduit between a supply hose and the monitor and legs or braces which radiate outwardly from the underside of the conduit and support the conduit on the ground. This gives rise to a safety problem because it is not firmly secured to the ground. When the angle of elevation of the discharge nozzle is too low (too close to the horizontal), the strong reaction force of the stream may cause the monitor and the base to lift up and tip to one side and flip wildly about. This situation is dangerous because the stream is powerful enough to injure a person, and it is difficult to get the monitor under control once it tips over.

Some monitors have included a safety pin which prevents the angle of elevation from being lowered below a certain angle (such as 35°) to a danger zone, but a safety pin can usually be removed or overridden. A monitor should always be tied to a stationary object, but sometimes under emergency conditions this is not always accomplished. Even if a safety pin is used and/or the monitor is tied another object, it could still tip and get out of control.

It is a general object of this invention to avoid the foregoing problems by providing a safety mechanism for automatically reducing the flow of water to the monitor in the event the monitor and the ground base start to lift off the ground.

SUMMARY OF THE INVENTION

Apparatus in accordance with this invention comprises a portable ground base including a liquid-carrying conduit having an inlet end and an outlet end. The inlet end is adapted to receive a liquid (such as water) from a supply hose, and the outlet end is adapted to be attached to the intake of a monitor. The conduit includes an intermediate portion between the ends that is closely spaced above the ground when the ground base is in the normal operating position. Mounted within the intermediate portion of the conduit is a valve that is movable between a closed position and an open position. Biasing means is connected between the valve and the conduit for urging the valve to the closed position. Water flow through the conduit also urges the valve to the closed position due to angling of the valve to flow of the water. A catch is connected between the valve and the conduit for releasably holding the valve in the open position to permit flow through the conduit. A trip is mounted on the ground base and connected to the catch, the trip sensing tilting movement of the ground base for disengaging the catch, thereby enabling the biasing means to move the valve to the closed position and block liquid flow.

BRIEF DESCRIPTION OF THE DRAWINGS

This invention will be better understood from the following detailed description taken in conjunction with the accompanying figures of the drawings, wherein.

DETAILED DESCRIPTION OF THE DRAWINGS

Figure 1:
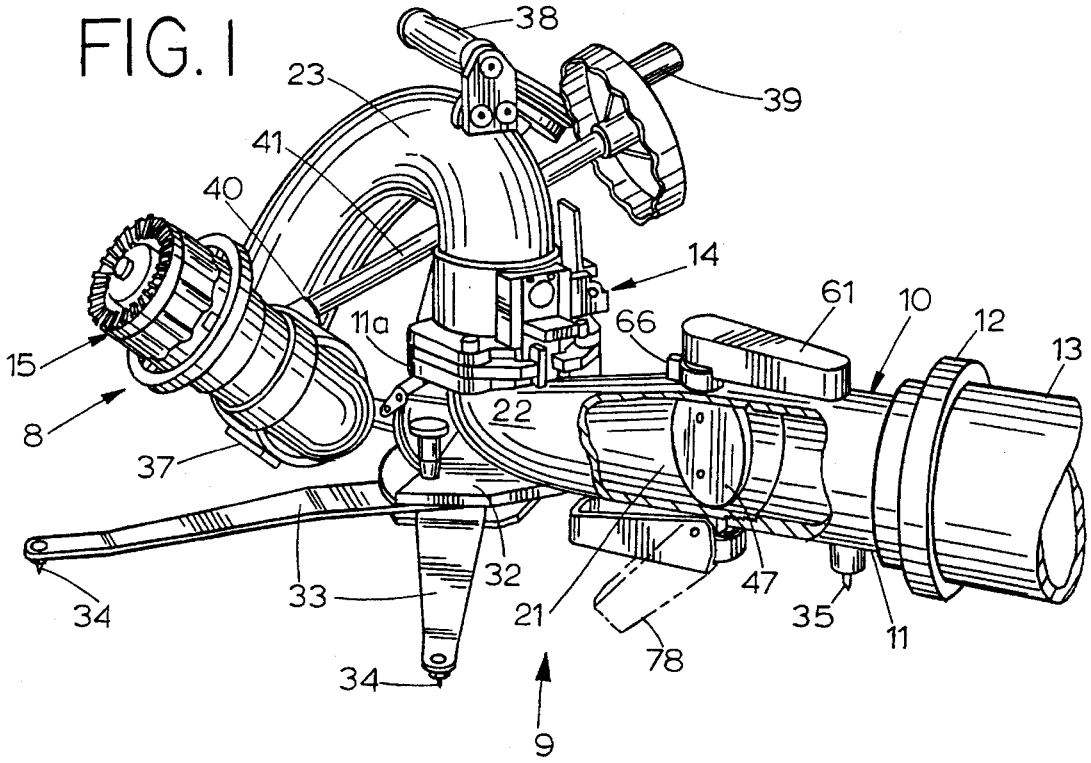
FIG. 1 is a perspective view of a monitor and a portable ground base including apparatus in accordance with the invention, with parts broken away to better show underlying parts.

FIG. 1 illustrates a monitor 8 mounted on a portable ground base 9 incorporating the present invention. As will be described hereinafter, the monitor 8 may be detached from the portable ground base 9 and mounted on a deck mount base (not illustrated). The base 9 comprises a conduit 10 having an inlet end 11 and an outlet end 11*a*, the conduit 10 being constructed to convey a liquid such as water under pressure. The inlet end 11 includes a coupling 12 which is adapted to be attached to a supply hose 13. Similarly, the outlet end 11*a* includes a swivel coupling 14 which is coupled to the monitor 8. An ordinary threaded connection is provided between the outlet of the monitor and the intake of a discharge nozzle 15. While the inlet end 11 may be formed by a single conduit as illustrated in FIG. 1, it may instead be formed by a conventional double inlet wye which receives water from two supplies.

The monitor 8 extends upwardly from the swivel coupling 14 to a curved part 23 which is shaped to direct the reaction force from the nozzle 15 relatively close to the ground and toward the center of the ground base 9 when in use.

Figure 2:
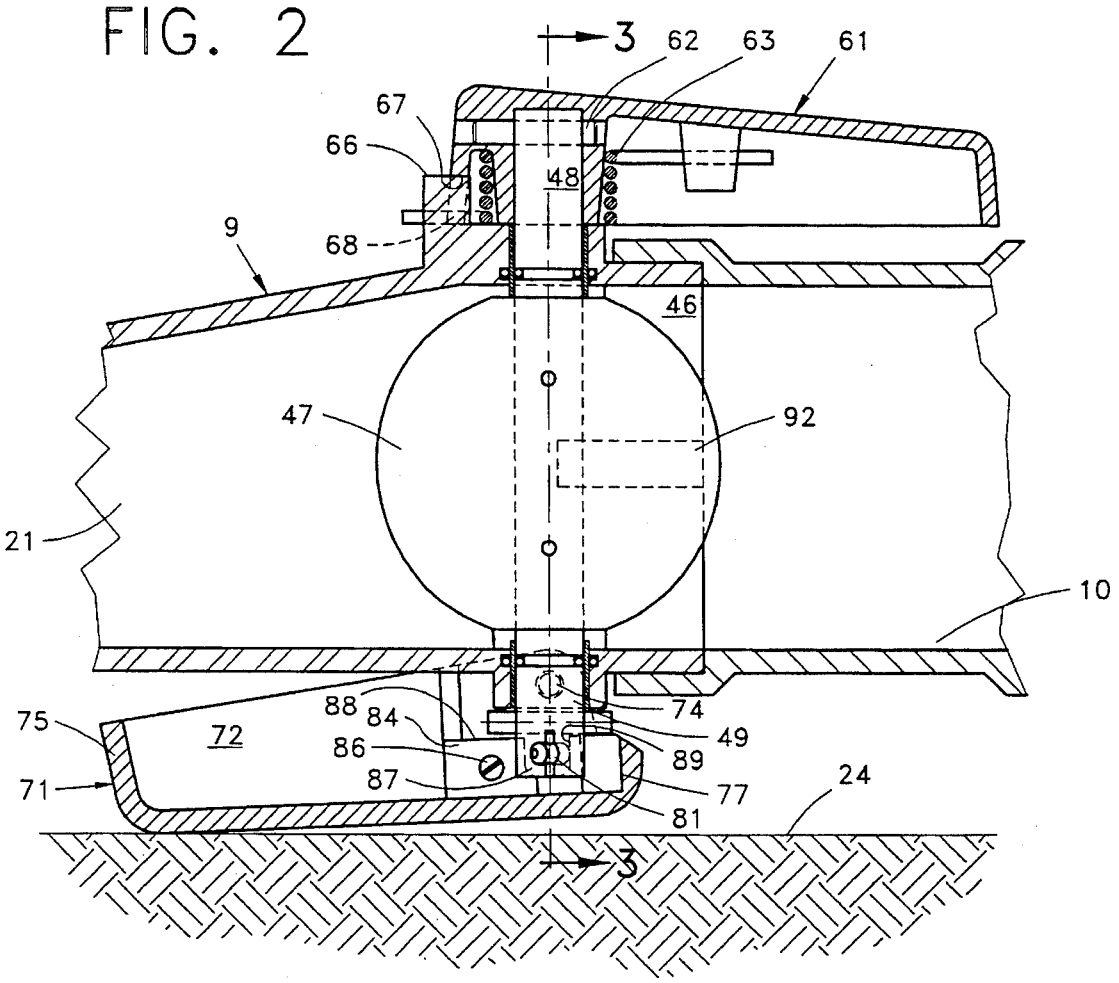
FIG. 2 is a fragmentary enlarged sectional view showing apparatus in accordance with the invention.

The portable ground base illustrated and described herein is, during use, normally placed in an operating position on a flat support surface indicated by the numeral 24 in FIG. 2. The support surface 24 may, for example, be pavement or the ground adjacent a fire fighting location, and normally a relatively horizontal flat surface is chosen. The ground base includes a support and stabilizing structure formed by a support plate 32 (FIG. 1) which is rigidly secured to the underside of the conduit 10, and a plurality of legs or arms 33 which radiate outwardly from the support plate 32. In the present instance, the legs 33 may be folded to positions close to the conduit 10 for ease in transporting the base and monitor when not in use. Extending downwardly from the outer end of each leg 33 is a pin or spike 34 which helps to hold the monitor in place on the support surface 24 and restrains the reaction force from sliding the base on the surface. Another spike 35 is provided adjacent the inlet end 11 on the underside of the base for the same purpose.

The monitor includes swivel connections which enable the operator of the monitor to direct the stream from the nozzle 15 in the desired direction and at the desired angle of elevation. One swivel connection is formed by the swivel coupling 14 between the monitor 8 and the ground base 9 which enables the monitor 8 to be rotated by the operator on a vertical axis which extends through the center of the swivel connection 14. The second swivel connection 37 is between the monitor 8 and the nozzle 15 and it enables the nozzle 15 to be pivoted on a horizontal axis (or an axis that is substantially parallel to the support surface 24). When in use, an operator of the monitor typically holds a handle 38 in one hand and a wheel handle 39 in the other hand. The handles enable the operator to turn the monitor 8 on the vertical axis and the handle 39 enables the operator to raise or lower the nozzle 15. The end 40 of a wheel shaft 41 is connected to the swivel connection 37 by, for example, a worm gear arrangement. The handle 38 may also be used for carrying the portable monitor from one location to another.

While the swivel coupling 14 may form a secure connection between the monitor 8 and the ground base 9, in the present instance, the swivel coupling 14 is designed to enable the monitor 8 to be disconnected and removed from the ground base support 9. This arrangement is advantageous because the monitor may be removed from the portable ground base and coupled to a deck mount base (not illustrated) secured, for example, to the top of a fire truck.

During use of the monitor 8 on the portable ground base 9, the discharge nozzle 15 produces a powerful stream having a strong reaction force. It will be apparent from FIG. 1 that if the angle of elevation of the discharge nozzle 15 is relatively low, the line of the reaction force approaches the horizontal (or close to parallel with the support surface 24), and the reaction force may be sufficient to tip the monitor and lift the legs 33 on one side upwardly, even though the legs 33 extend outwardly a substantial distance from the center of the ground base. In the event the monitor were to tip over and become out of control, the monitor could produce damage or bodily harm due to the reaction force. Apparatus in accordance with this invention decreases this risk by reducing the water flow through the ground base 9 in the event the base 9 lifts off the support surface 24.

Figure 3:
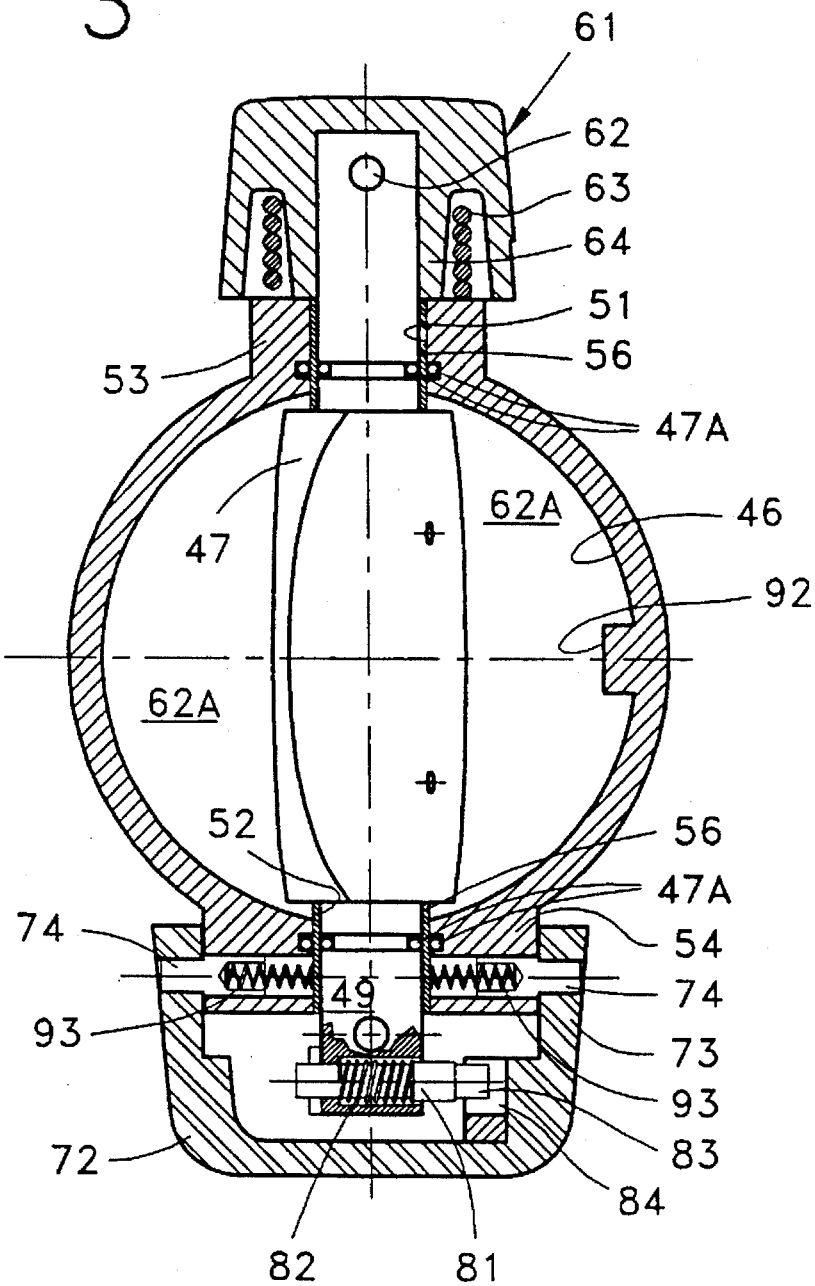
FIG. 3 is a sectional view taken on the line 3—3 of FIG. 2.
Figure 4:
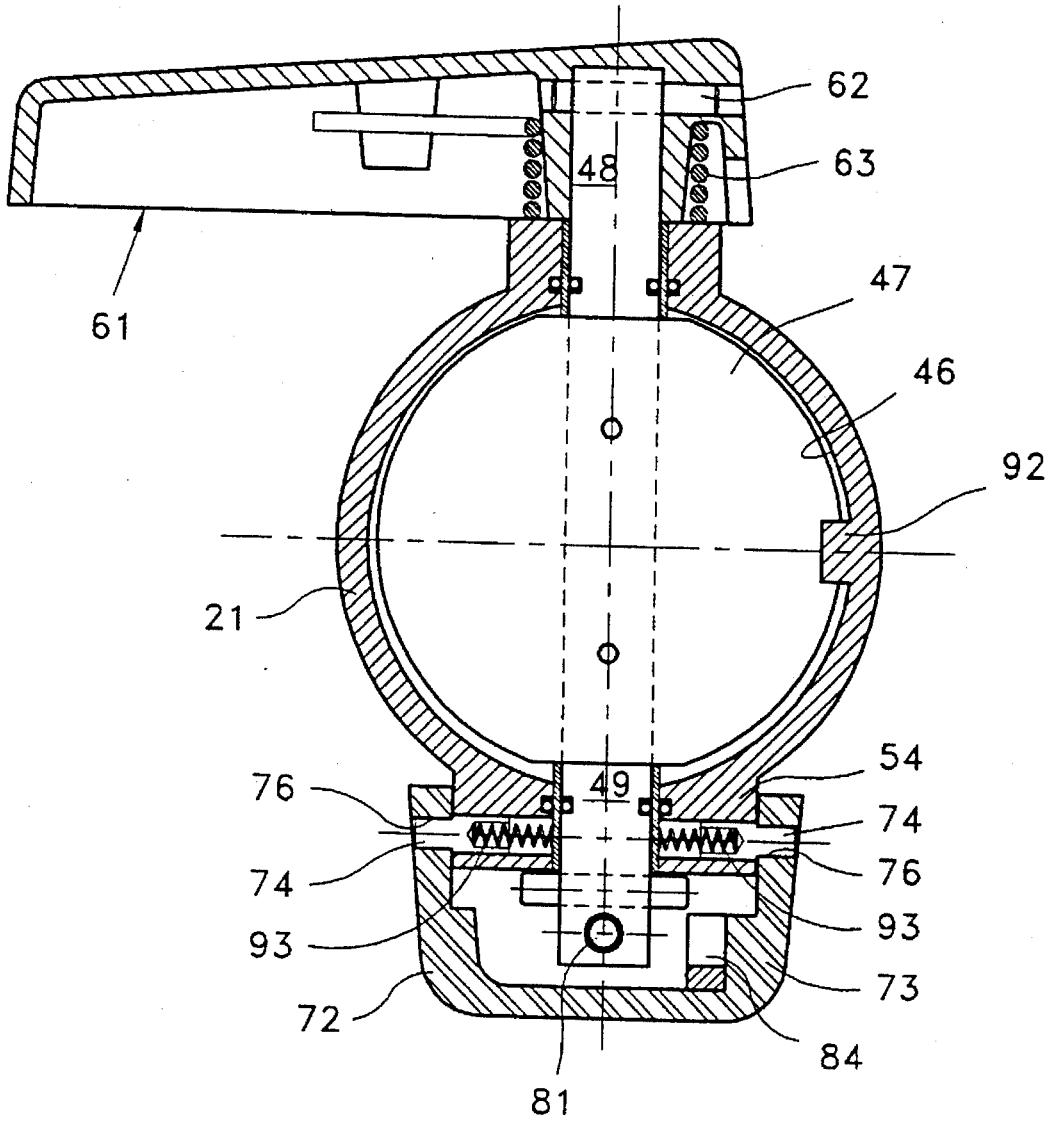
FIG. 4 is a view similar to FIG. 3 but showing another position of the parts.

With particular reference to FIGS. 2 to 5, the conduit 10 includes a valve part 21 and an elbow part 22 which is downstream of the valve part 21 and terminates at the end 11*a*. The valve part 21 is formed by a tubular wall 46 which is substantially circular is cross section as shown in FIGS. 3 and 4. Pivotably mounted within the tubular wall 46 is a disc or butterfly valve 47 having an outer diameter which is slightly smaller than the internal diameter of the wall 46 as shown in FIG. 4. In the present instance, the valve 47 is mounted for turning movement on a vertical axis (when the monitor is placed on a horizontal support surface 24) formed by a pivot shaft having upper and lower pivot ends 48 and 49, the valve 47 being attached to the pivot shaft. Circular openings 51 and 52 are formed within bosses 53 and 54 formed on the upper and lower sides of the wall 46, and tubular sleeve bearings 56 are mounted within the openings 51 and 52. The upper and lower ends 48 and 49 extend into the sleeve bearings 56 in order to rotatably support the ends 48 and 49 and the valve 47 relative to the wall 46. O-rings 47A are preferably provided on the inner and outer sides of the sleeve bearings 56 in order to seal these connections.

The upper end 48 extends upwardly from the upper surface of the boss 53 and a handle 61 is secured to end 48 by a roll pin 62 that extends through openings formed crosswise through the end 48 and the handle 61. The handle 61 extends perpendicularly to the axis of the ends 48 and 49, thereby enabling an operator of the monitor to turn the pivot shaft and the valve 47 by applying a turning force on the handle 61. The handle 61 is preferably oriented such that it extends approximately parallel to the flat sides of the valve 47. With reference to FIGS. 3 and 4, the handle 61 and the valve 47 are movable between an open or set position shown in FIGS. 2, 3 and 3A and a closed or trip position shown in FIG. 4. When in the open position, the valve 47 has its plane extending at a small angle to the axis of the tubular wall 46, thereby creating relatively large flow passages 62A (FIG. 3) on both sides of the valve 47. However, when the valve 47 is in the closed position shown in FIG. 4, the flat plane of the valve is perpendicular to the axis of the tubular wall 46 and it substantially closes the flow passages 62A, thereby substantially reducing the flow of liquid through the conduit 10.

Figure 3A:
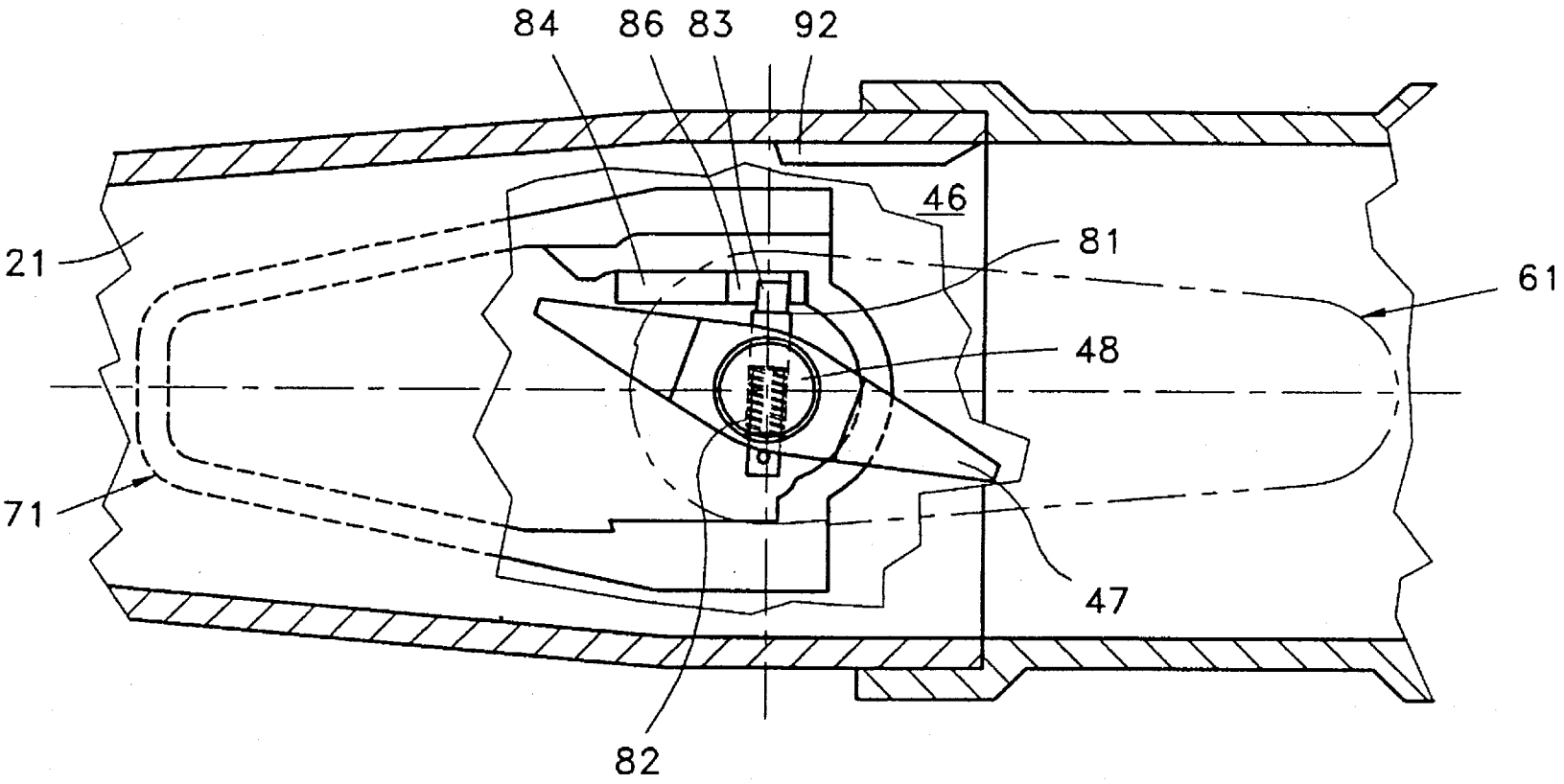
FIG. 3A is a sectional view taken on the line 3—3 of FIG. 3.

With reference to FIG. 3A, the letter A references a valve plane extending through the center of the valve 48, and the letter B references a conduit plane extending through the center of the conduit 10. During operation, both planes A and B are substantially vertical, and a stream of water under high pressure flows from right to left through the conduit 10. In the present specific example of the invention, the two planes A and B make an angle of about 20° because the valve 47 is cocked at an angle to the water flow. Because of this angle, the force of the water stream produces a substantial rotational torque tending to turn the valve 47 clockwise to the closed position shown in FIG. 4. When the valve 47 is in the closed position, the water pressure acts equally on the opposite sides of the valve pivot or mounting shaft, and the water does not produce a rotational torque on the valve 47. It may also be noted that the water would not produce a torque on the valve if the valve were turned to align the planes A and B, but the valve is not placed in this position.

It was previously mentioned that a double inlet wye may be attached to the base 9 instead of the single conduit 13. A wye may supply water through both inlets, through the right inlet only or through the left inlet only. In all three modes of operation, the water stream produces a torque tending to close the valve 47, but the torque is least powerful when the flow is from the left inlet only because the valve 47 is angled toward the left.

The valve 47 (and the handle 61) are biased toward the closed position shown in FIG. 4 by a torsion spring 63 which is connected between the upper boss 53 and the handle 61. The torsion spring 63 is wound around the upper pin 48 and a sleeve 64 of the handle 61. The spring 63 is wound such that it provides a strong bias on the handle 61 tending to turn the valve 47 to the closed position shown in FIG. 4. A stop 92 formed on the interior of the wall 46 is engaged by the valve 47 and prevents movement of the valve 47 past the closed position.

The extent of angular movement of the handle 61 and the valve 47 in the direction of the open position shown in FIG. 3 is limited by a stop arrangement best shown in FIG. 2. An upwardly projecting stop 66 is formed on the upper side of the tubular wall 46, and a recess 67 is formed in the handle 61, the stop 66 extending into the recess 67. The recess 67 includes a stop surface 68 which engages the stop 66 when the handle 61 is moved to place the valve 47 in the open position, thereby preventing movement of the valve 47 past the open position. The valve 47, when in the open position, is angled with respect to the direction of the water flow so as to provide a torque tending to close the valve 47 due to the force of the water flow.

The monitor further includes means for sensing whether the monitor is in the correct operating position or whether the monitor has tipped or lifted excessively during operation. In the present instance, the sensing means comprises a trip lever in the form of a shoe 71. The shoe 71 includes two sides 72 and 73 which extend upwardly closely adjacent the sides of the lower boss 54. Two pivot pins 74 extend through holes 76 formed in the side walls 72 and 73 and into the lower boss 54. From the pivot pins 74, the shoe extends a substantial distance laterally of the shaft ends 48 and 49 and parallel to the tubular wall 46, and the shoe is pivotable on the pivot pins 74.

Figure 5:
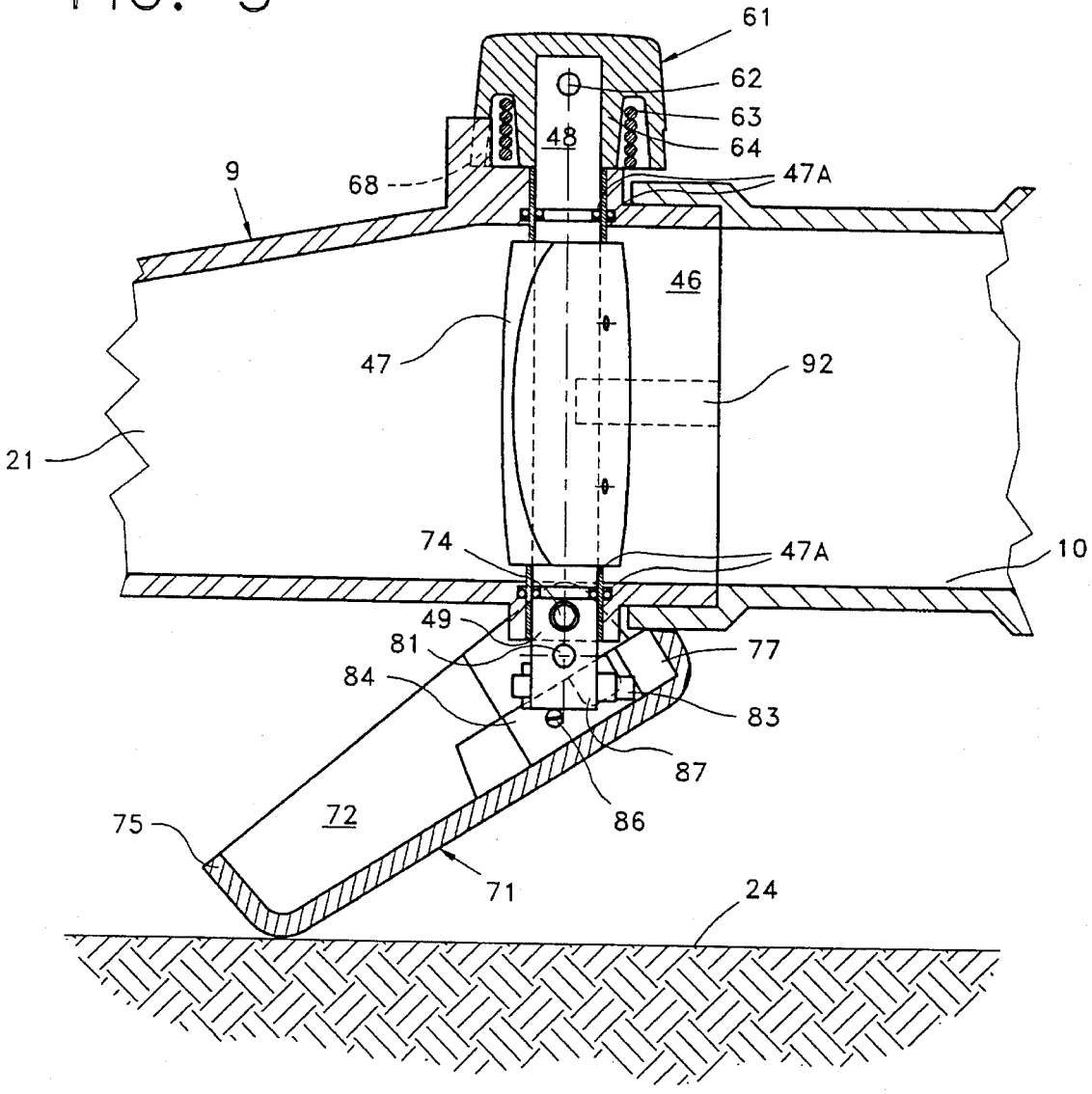
FIG. 5 is a sectional view showing parts in the tripped position.

Connected between the shoe 71 and the lower end 49 of the support shaft for the valve 47 is a retainer or trip mechanism comprising a trip pin 81 (see FIGS. 3 and 3A) which extends through a hole 77 formed laterally of the axis of the end 49 and laterally of the valve 47. One end 83 of the trip pin 81 extends laterally of the pin 49 substantially up to one side wall 73 of the shoe 71. The hole 77 is countersunk to produce an enlarged portion, and a compression spring 82 is mounted around the trip pin 81 in the enlarged portion of the hole 77. The pin 81 includes an enlarged land 78 and the spring 82 is located between the land 78 and the reduced diameter portion of the hole 77, whereby the spring 82 urges the trip pin 81 toward the right as seen in FIG. 3. A retainer pin 79 extends through the trip pin 81 and prevents the trip pin 81 from moving out of the hole 77. A trip bracket 84 (FIGS. 2 and 5) is secured through the interior side surface of the shoe wall 73 by a retaining screw 86 (see FIG. 2). A U-shaped recess 87 is formed in the bracket 84, the recess 87 extending to the upper surface 88 of the bracket 84, and the pin end 83 extends into the recess 87 when the shoe 71 rests on the support surface 24 and when the valve 47 is in the open position. The shoe 71 is urged to rotate as follows: The torsion spring 63 and force due to the water flow produce a torsional force tending to rotate the shoe 71, which is resisted by the trip pin 81 engaging the surface 89. From FIG. 2, for example, it will be seen that the trip pin 81 and its point of engagement with the bracket 84 are spaced below the pivot pins 74, and consequently the torsional force on the valve 47 and on the trip pin 81 tends to rotate the shoe 71 in the counterclockwise direction as seen in FIG. 2. The force on the shoe is resisted by the engagement of the shoe 71 with the support surface 24, and the force is not great enough to lift the weight of the entire assembly. Consequently, when the monitor is lifted off the support surface 24, the outer end 75 of the shoe 71 swings downwardly on the pivot axis formed by the two pivot pins 74 to the dash-dot line 78 shown in FIG. 1 and as shown in solid lines in FIG. 5. Thus, the shoe 71 senses a lifting or tilted position of the monitor by swinging downwardly. As illustrated in FIG. 5 and to a lesser extent in FIG. 4, in the event the monitor tilts or is lifted off the support surface 24, the shoe 71 swings downwardly on the pin 74 due to the force from the end of trip pin 83, due to spring 63, bearing against side 89 of the recess 87, and the bracket 84 tilts to the position where the trip pin 81 moves out of the recess 87. In this event, the pin 81 is no longer restrained by the bracket 84; thus, the torsion spring 63 and the force from the water velocity pivots the valve 47 to the closed or tripped position illustrated in FIG. 4.

To summarize the operation of the portable monitor, assume that the supply hose 13 is attached by the coupling 12 to the inlet end 11 of the ground base, that a discharge nozzle 15 is attached to the outlet end of the monitor, and that the ground base 9 is on a support surface 24. With the valve 47 and handle 61 in the closed position, the trip pin 81 is retracted into shaft end 49 by shoe surface 77. The operator grasps the handle 61 and turns it to place the valve 47 in the open or set position illustrated in FIGS. 2 and 3. When the trip pin 81 enters the recess 87, the trip pin spring 82 extends the trip pin 81 into the recess 87. In this position, the trip pin 81 extends substantially parallel to the pivot pin 74. When the operator releases the handle 61, the force of the torsion spring 63 tends to turn the valve 47 and the pins 48 and 49, but the end 83 of the trip pin engages a side 89 of the recess 87. As illustrated in FIG. 3, the valve 47 is angled slightly relative to the centerline of the passage 46 at this position. This engagement prevents the valve 47 and the trip pin 81 from turning and consequently the valve 47 is held in the open or set position shown in FIGS. 2 and 3. The operator then adjusts the direction of the nozzle 15 and turns on the supply of liquid.

In the event the operator places the nozzle 15 at a low angle of elevation, the reaction force produced by the stream causes the legs 33 on one side of the ground support to lift off the support surface 24. The torsion spring 63 and force of water flowing past valve 47 create a torsional force that is resisted by the trip pin 81 held by the shoe 71, and holds the shoe 71 on the support surface 24, and the shoe swings on the pivot pin 74 (FIG. 5) as the base 9 rises. The recess 87 moves radially outwardly relative to the trip pin 81, and when the end 83 of the trip pin 81 moves out of engagement with the side wall 89 of the recess 87, the trip pin 81 is no longer restrained by the bracket 84 and the torsion spring 63 and water flow swing the handle 61 and the valve 47 to the tripped or closed position illustrated in FIG. 4. In this position, the valve 47 almost fully blocks the flow path through the passages 62 thereby effectively reducing the water flow. With the water flow reduced, the reaction force is greatly reduced. The trip pin 81 now extends clear of the bracket 84 as shown in FIG. 4 and does not interfere with the swinging movement of the shoe (see FIG. 4). The operator, of course, is warned of the dangerous direction of the discharge nozzle 15 and should adjust the nozzle to a higher angle of elevation. The operator may then turn off the water supply, reset the trip mechanism by turning the handle 61 as previously described, and turn on the water again. While the valve 47 may not entirely close off the flow through the passages 62, it at least reduces the flow to a lower level which enables the operator to bring the monitor under control.

While the shoe 71 may be permanently attached to the lower boss 54, in the present instance, a releasable springpin arrangement is provided. As best illustrated in FIGS. 3 and 4, each of the pins 74 is urged outwardly into the holes 76 formed in the side walls 72 and 73 of the shoe by a compression spring 93. The outer ends of the pins 74 are exposed at the outer ends of the holes 76 so that they may be pushed in against the force of the springs 93 to move the pins out of engagement with the holes 76, thereby allowing the shoe to be removed from the lower boss 54.

It will be apparent from the foregoing that a novel and useful automatic safety mechanism has been provided. With the valve 47 in the open position shown in FIG. 3 and with the trip pin 81 in the recess 87, the valve 47 is held in the open position and the liquid flows freely through the passage. However, in the event the monitor starts to tip or otherwise lift off the support surface 24, the shoe 71 swings to the position shown in FIG. 5 thereby allowing a disengagement of the trip pin with the bracket 84. The torsion spring then immediately swings the valve to the tripped or closed position and reduces the flow.

Minor modifications may be made without departing from the scope of the present invention. For example, while the recess has been shown as formed in a bracket 84 which is attached to a side wall of the shoe, it will be apparent that the recess could instead be formed directly in the side wall of the shoe.

What is claimed is:

1. A portable base for a monitor, said base being operable to convey a liquid from a supply to the monitor, said base when in customary use being placed in an operating position on a support surface, said base comprising a conduit forming a flow passage between an inlet end and an outlet end, said inlet end being connectable to said supply and said outlet end being connectable to the monitor, and valve means mounted on said conduit for automatically closing said flow passage in the event that said base lifts off the support surface, said valve means including a valve pivotably mounted in said flow passage and movable between open and closed positions, and trip means connected to said valve and responsive to the base lifting from the support surface for moving said valve to said closed position.

2. A portable base as set forth in claim 1, wherein said valve means further comprises a manually operable handle attached to said valve for turning said valve to said open position.

3. A portable base as set forth in claim 1, wherein said trip means includes bias means for urging said valve from said open position to said closed position.

4. A portable base as set forth in claim 3, wherein said bias means comprises a spring connected between said valve and said conduit, and an angle between said valve and said flow passage.

5. A portable base as set forth in claim 1, wherein said trip means comprises a shoe pivotably mounted on said conduit and having a first position when said base is in said operating position and a trip position when said base lifts off said support surface, and a trip pin engageable between said valve and said shoe when said valve is in said open position and said shoe is in said first position, said trip pin disengaging said valve when said shoe moves to said trip position.

6. A monitor and a ground base for conveying a liquid from a supply to a discharge nozzle, said ground base when in customary use being placed in an operating position on a support surface, said ground base comprising a conduit having an inlet end and said monitor having an outlet end, said inlet end being connectable to a supply and said outlet end being connectable to said nozzle, said conduit including a valve portion between said inlet and outlet ends, a valve mounted within said valve portion and movable between a closed position and an open position, retainer means operable between said valve portion and said valve for releasably engaging said valve when in said open position, biasing means between said conduit and said valve for urging said valve toward said closed position, and trip means responsive to movement of said ground base out of said operating position for releasing said engagement of said valve whereby said biasing means moves said valve to said closed position.

7. Apparatus for conveying a liquid from a supply to a discharge nozzle, said apparatus when in customary use being placed in an operating position on a support surface, said apparatus comprising a conduit forming a flow passage between an inlet end and an outlet end, said inlet end being connectable to a supply, a. valve mounted in said flow passage within said conduit and movable between a first position wherein said flow passage is substantially closed and a second position wherein said flow passage is substantially open, a shoe movably mounted on said conduit and engageable with said support surface when said apparatus is in said operating position, said shoe being in a normal position when said apparatus is in said operating position and said shoe being in a trip position when said apparatus is displaced from said support surface, and a trip engageable between said valve and said shoe, said trip and said shoe being operable when said shoe is in said normal position to hold said valve in said second position, and said trip and said shoe when said shoe is in said trip position enabling said valve to move to said first position.

8. Apparatus as set forth in claim 7, and further including biasing means for urging said valve from said second position toward said first position.

9. Apparatus as set forth in claim 8, wherein said biasing means further urges said shoe toward said trip position.

10. Apparatus as set forth in claim 8, wherein said biasing means comprises means for positioning said valve at an angle to said flow passage whereby liquid moving through said flow passage urges said valve toward said first position.

11. Apparatus as set forth in claim 8, wherein said biasing means comprises a torsion spring connected between said valve and said conduit.

12. Apparatus as set forth in claim 7, and further comprising a handle attached to said valve.

* * * * *